US005850955A

United States Patent [19]

Barr

[11] Patent Number: 5,850,955

[45] Date of Patent: Dec. 22, 1998

[54] BOW HOLDER APPARATUS

[76] Inventor: Thomas Dale Barr, R.D. #1 Box 177C, Dysart, Pa. 16636

[21] Appl. No.: 978,624

[22] Filed: Nov. 25, 1997

[51] Int. Cl.[6] ..... A45F 5/00

[52] U.S. Cl. ..... 224/222; 224/267; 224/269; 224/916; D3/221; D3/262

[58] Field of Search ..... 224/191, 222, 224/267, 269, 270, 916, 219; 24/3.1, 3.2; D3/215, 221, 226, 229, 254, 262

[56] References Cited

U.S. PATENT DOCUMENTS

| | | | |
|---|---|---|---|
| D. 282,271 | 1/1986 | Morrell | D3/221 |
| 1,287,875 | 12/1918 | Careless | 224/222 |
| 2,888,705 | 6/1959 | Bray | 224/222 |
| 3,208,653 | 9/1965 | Wallace | 224/222 |
| 4,103,807 | 8/1978 | Lyon et al. | 224/222 |
| 4,159,792 | 7/1979 | Siegal | 224/267 |
| 4,848,624 | 7/1989 | Clem | 224/267 |

FOREIGN PATENT DOCUMENTS

| | | | |
|---|---|---|---|
| 72856 | 10/1945 | Norway | 224/222 |

*Primary Examiner*—Allan N. Shoap
*Assistant Examiner*—Gregory M. Vidovich

[57] ABSTRACT

A bow holder apparatus including a new and improved pouch member that has an upper peripheral edge with a pair of extension arms, a lower end portion and a pouch body. The upper peripheral edge defines an entry way into an interior of the pouch member. The lower end portion having J-hook projection engaging a boot lace of the archer. Lastly, a plurality of strap members are fixedly attached to one of the pair of extension arms of the upper peripheral edge for supporting the pouch member about and archer's leg.

5 Claims, 2 Drawing Sheets

BOW HOLDER APPARATUS

BACKGROUND OF THE INVENTION

1. Field of the Invention

The present invention relates to a bow holder apparatus and more particularly pertains to providing a device for holding a compound or recurve bow against an archer's leg when hunting or participating any other activities.

1. Description of the Prior Art

The use of a bow holster is known in the prior art. More specifically, bow holsters heretofore devised and utilized for the purpose of carrying a bow are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,621,752 to Youngbauer discloses a nonrigid bow holster. U.S. Pat. No. 4,103,807 to Lyon and Whyel discloses compound bow holsters. U.S. Pat. No. 4,760,944 to Hughes discloses a sling assembly for bows, rifles and the like. U.S. Pat. No. 5,165,584 to Meagher and Gauthier discloses an archer's bow and carrying device. U.S. Pat. No. 4,121,743 to Burton discloses a bow transport holster. Lastly, U.S. Pat. No. Des. 3,009,989 to Kovach discloses a bow holster.

In this respect, the bow holder apparatus according to the present invention substantially departs from the conventional concepts and designs of the prior art, and in so doing provides an apparatus primarily developed for the purpose of providing a device for holding a compound or recurve bow against an archer's leg when hunting or participating any other activities.

Therefore, it can be appreciated that there exists a continuing need for a new and improved bow holder apparatus which can be used for providing a device for holding a compound or recurve bow against an archer's leg when hunting or participating any other activities. In this regard, the present invention substantially fulfills this need.

SUMMARY OF THE INVENTION

In view of the foregoing disadvantages inherent in the known types of bow holsters now present in the prior art, the present invention provides an improved bow holder apparatus. As such, the general purpose of the present invention, which will be described subsequently in greater detail, is to provide a new and improved bow holder apparatus which has all the advantages of the prior art and none of the disadvantages.

To attain this, the present invention essentially comprises a generally cylindrical pouch member. The pouch member has an upper peripheral edge, a lower end portion and a pouch body. The upper peripheral edge is rigid and defines an entry way into an interior of the pouch member. The upper peripheral edge has a pair of extension arms projecting outwardly from the pouch body. A generally rectangular pocket is attached to the pouch body. The pouch member is sized for allowing a lower one third of a bow to be seated therein. Also, a rigid support member being positioned within the interior of the pouch body and juxtapose the lower end portion, the support member being in receipt of the bow and centering thereof.

Additionally, a plurality of strap members are fixedly attached to one of the pair or extension arms. The plurality of straps form a first strap and a second strap. The first strap is adjacent the pouch body. The second strap is spaced from the first strap. The plurality of straps are fastened about a thigh of a leg of an archer for supporting the pouch member. The plurality of straps, when supporting the pouch body about the archer's thigh, allow the pouch body to be extended in a vertical orientation with respect to a foot of the archer when the archer is seated. Also, the plurality of straps, when supporting the pouch body about the archer's thigh, allow the pouch body to collapse against a lower leg of the archer when the archer is standing.

Lastly, an inverted J-hook projecting from the lower end portion of the pouch member. The J-hook engaging a boot lace of the archer for retaining the lower end portion of the pouch member above a boot of the archer.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bow holder apparatus which has all the advantages of the prior art bow holsters and none of the disadvantages.

It is another object of the present invention to provide a new and improved bow holder apparatus which may be easily and efficiently manufactured and marketed.

It is a further object of the present invention to provide a new and improved bow holder apparatus which is of a durable and reliable construction.

An even further object of the present invention is to provide a new and improved bow holder apparatus which is susceptible of a low cost of manufacture with regard to both materials and labor, and which accordingly is then susceptible of low prices of sale to the consuming public, thereby making such bow holder apparatus economically available to the buying public.

Still yet another object of the present invention is to provide a new and improved bow holder apparatus which provides in the apparatuses and methods of the prior art some of the advantages thereof, while simultaneously overcoming some of the disadvantages normally associated therewith.

Still another object of the present invention is to providing a device for holding a compound or recurve bow against an archer's leg when hunting or participating any other activities.

Lastly, it is an object of the present invention to provide a new and improved pouch member that has an upper peripheral edge with a pair of extension arms, a lower end portion and a pouch body. The upper peripheral edge defines an entry way into an interior of the pouch member. The lower end portion having J-hook projection engaging a boot lace of the archer. Included is a plurality of strap members are fixedly attached to one of the pair of extension arms of the upper peripheral edge for supporting the pouch member about and archer's leg.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
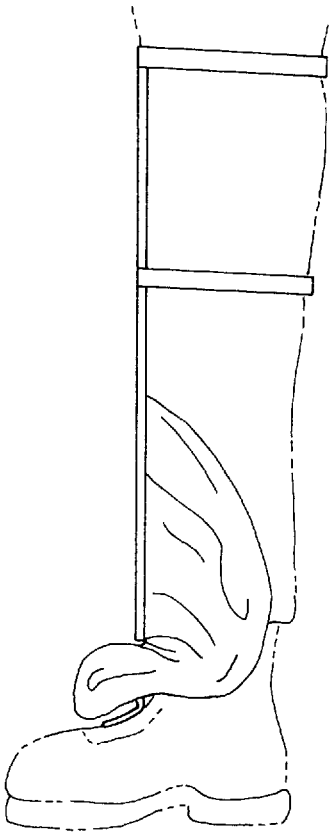
FIG. 1 is a perspective illustration of the preferred embodiment of the bow holder apparatus constructed in accordance with the principles of the present invention and with the archer standing.

With reference now to the drawings, and in particular to FIG. 1 thereof, a new and improved bow holder apparatus embodying the principles and concepts of the present invention and generally designated by the reference numeral 10 will be described.

The present invention, the new and improved bow holder apparatus, is comprised of a plurality of components. Such components in their broadest context include a pouch and straps. Such components are individually configured and correlated with respect to each other so as to attain the desired objective.

Figure 3:
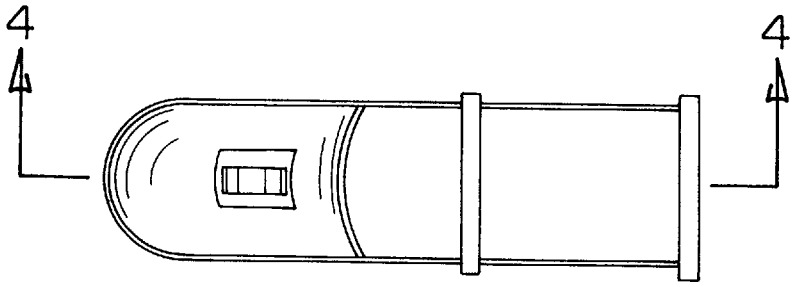
FIG. 3 is a top view of the bow holder apparatus of the present invention.

More specifically, the present invention includes a generally cylindrical pouch member. The pouch member has an upper peripheral edge 12, a lower end portion 14 and a pouch body 16. The pouch body is made of a flexible, easy care fabric. The upper peripheral edge is rigid and preferably made of a light weight metal such as aluminum. The upper peripheral edge defines an entry way into an interior 18 of the pouch member. The upper peripheral edge has a pair of extension arms 22 projecting outwardly from the pouch body, as shown in FIG. 3. The pouch member is sized for allowing a lower one third of a bow to be seated therein.

Figure 2:
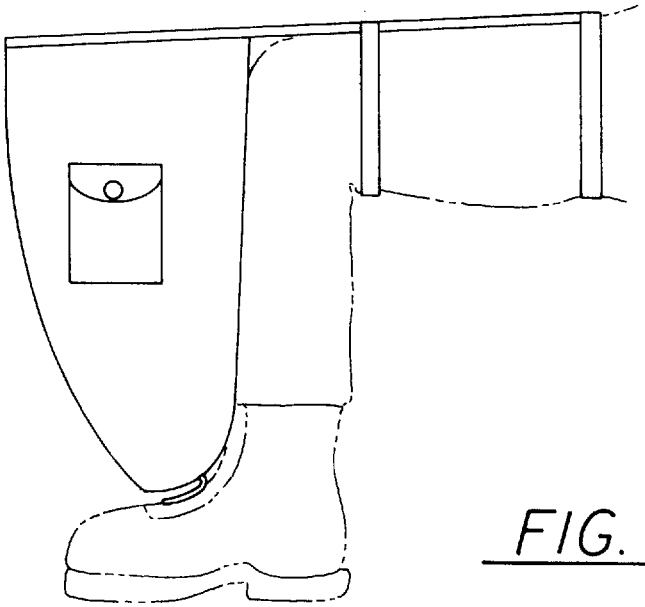
FIG. 2 is a perspective illustration of the preferred embodiment of the bow holder apparatus constructed in accordance with the principles of the present invention and with the archer sitting.

Also, as depicted in FIG. 2, a generally rectangular pocket 24 is attached to the pouch body. The pocket has an upper flap 26 and a snap-type fastener system 28 for securing the flap.

As best illustrated in FIG. 3, is a rigid support member 32. The rigid support member is positioned within the interior 18 of the pouch body and juxtapose the lower end portion 16. The support member is made of a plastic and receives the bow and centers the bow within the pouch member.

Additionally, a plurality of strap members 36 and 38 are fixedly attached to one of the pair or extension arms. The plurality of straps form a first strap 36 and a second strap 38. The first strap is adjacent the pouch body 16. The second strap is spaced from the first strap. The plurality of straps are fastened about a thigh 40 of a leg of an archer for supporting the pouch member. Each of the plurality of straps is covered with a hook and pile type fastener material. This allows the strap to be easily fastened around any size thigh. The plurality of straps, when supporting the pouch body about the archer's thigh, allow the pouch body to be extended in a vertical orientation with respect to a foot of the archer when the archer is seated. This orientation of the pouch member is shown in FIG. 2. Also, the plurality of straps, when supporting the pouch body about the archer's thigh, allow the pouch body to collapse against a lower leg of the archer when the archer is standing. This orientation of the pouch member is shown in FIG. 1.

Figure 4:
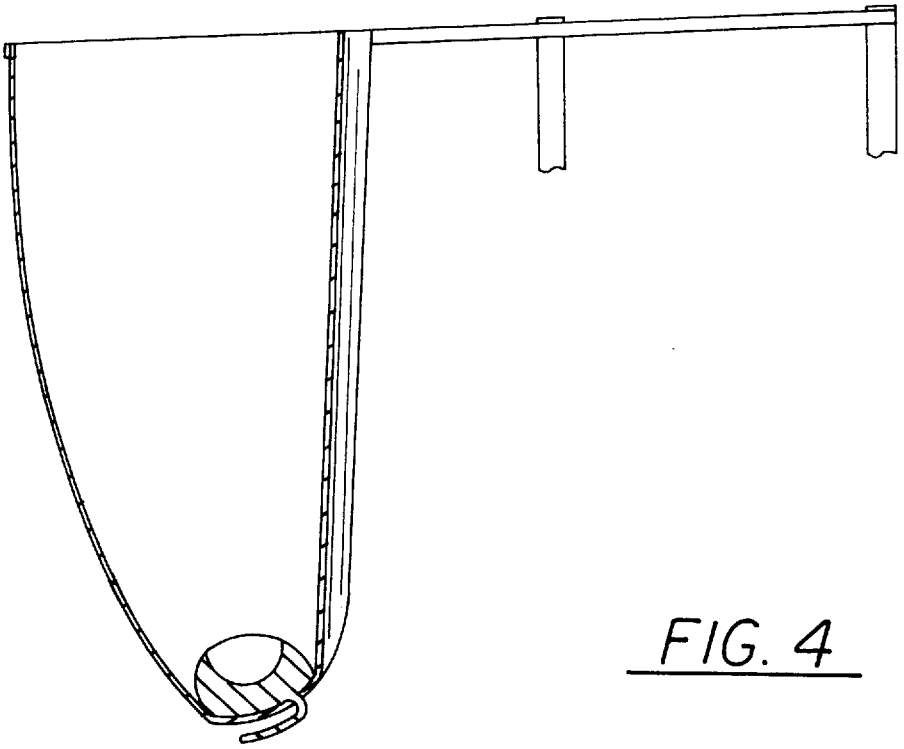
FIG. 4 is a cross sectional view of the bow holder apparatus taken along line 4-4 of FIG. 3 of the present invention.

Lastly, as seen in FIG. 4, is an inverted J-hook 44. The inverted J-hook projects from the lower end portion of the pouch member. The J-hook engages a boot lace 46, as seen in FIGS. 1 and 2, of the archer for retaining the lower end portion of the pouch member above a boot 48 of the archer.

The present invention bow holder apparatus is specially structured for holding a compound bow or recurve bow against a hunter's leg. The present invention is useful when the hunter is stand on the ground, or sitting in a tree stand.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bow holder apparatus for strapping to an archer's leg comprising in combination:

a generally cylindrical pouch member having an upper peripheral edge, a lower end portion and a pouch body therebetween, the upper peripheral edge being rigid and defining an entry way into an interior of the pouch member, the upper peripheral edge have a pair of extension arms projecting outwardly from the pouch body, a generally rectangular pocket being attached to the pouch body, the pouch member being sized for allowing a lower one third of a bow to be seated therein when a hunter is in a seated position;

a rigid support member being positioned within the interior of the pouch body and juxtapose the lower end portion, the support member being in receipt of the bow and centering thereof;

a plurality of strap members being fixedly attached to one of the pair of extension arms of the upper peripheral edge, the plurality of straps forming a first strap and a second strap, the first strap being adjacent the pouch body, the second strap being spaced from the first strap, the plurality of straps being fastened about a thigh of a leg of an archer for supporting the pouch member thereon, the plurality of straps, when supporting the pouch body about the archer's thigh, allowing the pouch body to be extended and substantially uncollapsed in a vertical orientation with respect to a foot of the archer when the archer is seated, the plurality of straps, when supporting the pouch body about the archer's thigh, allowing the pouch body to collapse against a lower portion of the leg of the archer when the archer is standing; and an inverted J-hook projecting from the lower end portion of the pouch member, the J-hook for engaging a boot lace of the archer for retaining the lower end portion of the pouch member above a boot of the archer and proximate an ankle portion of the archer's leg.

2. A bow holder apparatus comprising:

a pouch member having an upper peripheral edge with a pair of extension arms, a lower end portion and a pouch body therebetween, the upper peripheral edge defining an entry way into an interior of the pouch member, the lower end portion having a J-hook projection for engaging a boot lace of an archer; and a plurality of strap members being fixedly attached to one of the pair of extension arms of the upper peripheral edge for supporting the pouch member about a leg of the archer wherein said plurality of straps being secured about a thigh portion of the archer's leg and the J-hook projection engaging the boot laces proximate an ankle portion of the archer's leg such that the lower end portion of the pouch member is secured proximate the ankle portion of the archer's leg.

3. The bow holder apparatus as set forth in claim 2, wherein a generally rectangular pocket being attached to the pouch body.

4. The bow holder apparatus as set forth in claim 2, wherein the plurality of straps forming a first strap and a second strap.

5. The bow holder apparatus as set forth in claim 2, wherein the first strap being adjacent the pouch body, and the second strap being spaced from the first strap.

* * * * *